US008754787B2

(12) United States Patent
Furus et al.

(10) Patent No.: US 8,754,787 B2
(45) Date of Patent: Jun. 17, 2014

(54) MARINE SECURITY SYSTEM

(75) Inventors: Sven Furus, Pfungstadt (DE); Jan-Hendrik Stroher, Darmstadt (DE)

(73) Assignee: LexGabinia UG, Pfungstadt (DE)

( * ) Notice: Subject to any disclaimer, the term of this patent is extended or adjusted under 35 U.S.C. 154(b) by 608 days.

(21) Appl. No.: 12/920,487

(22) PCT Filed: Mar. 3, 2009

(86) PCT No.: PCT/EP2009/052498
§ 371 (c)(1),
(2), (4) Date: Dec. 7, 2010

(87) PCT Pub. No.: WO2009/109571
PCT Pub. Date: Sep. 11, 2009

(65) Prior Publication Data

US 2011/0102200 A1 May 5, 2011

(30) Foreign Application Priority Data

Mar. 7, 2008 (DE) ..... 10 2008 013 291

(51) Int. Cl.
*G08B 23/00* (2006.01)

(52) U.S. Cl.
USPC ..... 340/984; 340/557; 165/63; 239/284.1; 239/289; 239/172; 222/150; 222/175

(58) Field of Classification Search
USPC ..... 340/984, 557; 348/143; 356/5.01, 356/139.03; 239/284.1, 289, 172; 222/150, 222/175; 165/63; 134/10
See application file for complete search history.

(56) References Cited

U.S. PATENT DOCUMENTS

| | | | | |
|---|---|---|---|---|
| 5,842,644 | A * | 12/1998 | Remis et al. | 239/289 |
| 6,903,676 | B1 | 6/2005 | Frady et al. | |
| 6,985,212 | B2 * | 1/2006 | Jamieson et al. | 356/5.01 |
| 7,047,114 | B1 * | 5/2006 | Rogers | 701/21 |
| 2002/0186149 | A1 * | 12/2002 | Knaak | 340/984 |
| 2009/0187297 | A1 * | 7/2009 | Kish et al. | 701/21 |
| 2010/0214132 | A1 * | 8/2010 | Palazzo | 340/984 |

FOREIGN PATENT DOCUMENTS

| | | | |
|---|---|---|---|
| DE | 464 757 | C | 8/1928 |
| DE | 1 505 259 | A1 | 7/1969 |
| DE | 20 44 473 | A1 | 6/1972 |
| DE | 2161378 | A1 | 6/1973 |

(Continued)

OTHER PUBLICATIONS

International Search Report issued in PCT/EP2009/052498, mailed on Jul. 6, 2010, with translation, 7 pages.

(Continued)

*Primary Examiner* — Hoi Lau
(74) *Attorney, Agent, or Firm* — Osha Liang LLP

(57) ABSTRACT

There is proposed a marine security system which comprises at least two different monitoring elements (IRC, IRS) and a controller (PC) connected thereto in particular for warding off pirates, said controller triggering an alarm and/or activating alarm devices as a function of the displays or outputs of the different monitoring elements. In addition, at least two separate line or conduit systems (LA, LB) and outlets (DA, DB) connected thereto are provided, from which at least one substance can be discharged. In the event of an alarm, at least one substance is specifically supplied to the outlets (DA, DB), wherein said outlets are installed in different locations or sections (A1-A5, B1-B5) of the hull (S) and can be specifically activated there. The outlets (DA, DB) may also have different designs in order to optimally discharge the respective substance, for example by atomizing, nebulizing, spraying or pouring.

24 Claims, 8 Drawing Sheets

(56) References Cited

FOREIGN PATENT DOCUMENTS

| | | | | | |
|---|---|---|---|---|---|
| DE | 10 2006 016286 | A1 | | 10/2007 | |
| GB | 2141182 | A | | 12/1984 | |
| JP | 7-274157 | A | | 10/1995 | |
| JP | 2002-037178 | A | | 2/2002 | |
| JP | 2002-037179 | A | | 2/2002 | |
| JP | 2002037179 | A | * | 2/2002 | ..... B63B 17/04 |
| JP | 2007 503004 | A | | 2/2007 | |
| WO | 2004/075132 | A2 | | 9/2004 | |
| WO | 2007/107988 | A2 | | 9/2007 | |

OTHER PUBLICATIONS

"Long Range Acoustic Device," from http://de.wikipedia.org/wiki/Long_Range_Acoustic_Device, printed Aug. 31, 2010, 4 pages.
International Preliminary Report on Patentability (Chapter I of the Patent Cooperation Treaty) for International Application No. PCT/EP2009/052498, mailed on Oct. 14, 2010 (9 pages).
Office Action for Japanese Patent Application No. 2010-549124, dated Feb. 12, 2013, with English translation thereof (7 pages).
Office Action for Chinese Patent Application No. 2009801080388, dated May 11, 2012, 2013, with English translation thereof (14 pages).

* cited by examiner

MARINE SECURITY SYSTEM

The invention relates to a marine security system according to the preamble of claim 1. In particular the invention relates to a marine security system in which a substance is discharged via outlets at the outer part of a hull for warding off piracy attacks.

For securing ships and other vessels against assaults by pirates and other invaders it is desired to have reliable technical security systems. Piracy also nowadays is a serious risk for shipping companies, sailors, cargo owners and insurers. Nearly every day pirate attacks occur on the oceans which particularly lead to hostage-takings and seizures of ships. Nowadays pirates are equipped with most modern weapons and are well trained. The same also applies to terror organizations, which occasionally support piracy or also attack ships by themselves. Modern pirates operate on high seas or also in harbors. The range of their crimes reaches from simple theft to ship robbery, kidnapping and murder. Recently also attacks on skiffs and towed trains more and more occur. Further seizures of ships with ransom demands drastically increase. Moreover, pirates also attack private yachts offside the usual commercial shipping routes. About 80% of the global trade is made by merchant shipping. The transport routes often go through regions which are politically unsafe and sometimes through maritime bottlenecks, as for instance the straits of Malaga or the Suez channel. Attacks in these shipping lanes and especially blockades would already seriously harm the global trade and would cause additional costs in the range of billions of Euros. Most of the nowadays listed cases of piracy occur in territorial waters, thus near the coast. Victims of piracy are especially crews, ship owners and/or the owners, dealers of the shipped goods and the insurers. In particular among people of these circles there is an increasing interest and/or need for reliable security systems.

For the protection from pirates the crews on large ships usually close all open doors and hatches when there is a risk of an attack. On the lower decks some of the doors are welded. The real defense is made with water hoses from which water is sprayed under high pressure towards the aggressors. Also electrical fence systems are known which shall make it impossible to climb up the ship's side. Furthermore some ship owners instruct their crews to smash empty bottles on the weather deck because many pirates board the ships barefoot. There are also ships, in particular large ships on which a high voltage fence is installed around the ship for the defense of pirate attacks. Recently also a type of an "acoustic gun" became known by which aggressors were supposed to be frightened away with high-energy bundled high frequency tones. This preventive measure is also referred to as Long Range Acoustic Device and is described e.g. in the Internet at URL http://de.wikipedia.org/wiki/Long_Range_Acoustic_Device.

From JP-A-2002037178 a marine security system is known in which a line or conduit having small holes is arranged along the railing of a ship wherein hot steam is supplied to the conduit and is discharged through the holes in order to repel aggressors.

From JP-A-2002037179 a similar system is known in which high-boiling water discharges from a conduit having holes.

From DE 1 505 259 A there is known a security system for motor vehicles in particularly for taxi vehicles, the system comprises two conduits having spray nozzles which are foreseen for the distribution and spraying of gaseous or liquid mediums into the passengers compartment. The mixing and spraying of different mediums can be achieved by a mixer. An implementation in the marine or navy field is not described.

From DE 464 757 A an atomizing device for maritime vehicles or ships is known, the device comprises spray nozzles for acidic liquids, the nozzles being installed at the rear and being capable of producing white mist at moist air. At the bow of the ship therefore a water atomizing device is arranged which saturates the air with water vapor, wherein the water atomizing device is mounted at the end of a pipe being adjustable in height such that the ship crew is not annoyed.

Thus maritime security systems are known which comprise outlets for liquid or gaseous substances and which can be installed at the ship' hull, wherein the substance is supplied by means of a pump via the conduits to the outlets which discharge the substance for warding off piracy attacks outside the hull. Further to this, security systems for land vehicles are known which comprise several lines or conduits for distributing and mixing gaseous and or liquid mediums to be sprayed.

These known systems however are not very efficient and are hardly suitable with regard to their use in the marine sector. As far as only water vapor steam is discharged this can easily be repelled by the use of adequate protective clothing or protective shields. Further to this the production and discharge of water vapor as well as high boiling water implies rather high energy expenditure. Moreover, the use of high boiling water can also easily be repelled by simple countermeasure, such as protective shields or a like. As far as acidic substances are discharged or sprayed, these can also be repelled by particular protective clothing. Therefore the conventional solutions cannot efficiently prevent that aggressors may obtain entrance to the ship.

Therefore it is object of the present invention to improve a marine security system of the initially mentioned type such that the above mentioned drawbacks are overcome in an advantageous manner. In particularly a marine security system shall be proposed that makes it impossible for the pirates or the aggressors to get entrance to the ship or that makes it at least considerably more difficult for them.

The object is solved by a marine security system comprising the features of claim 1.

Accordingly a marine security system is proposed which comprises at least two different monitoring elements and a controller connected thereto which triggers an alarm and/or activates alarm devices as a function of the displays or indications coming from the different monitoring elements.

As monitoring elements various monitoring devices can be used, such as an optical camera, infrared camera and/or radar apparatus or acoustic sensor, movement sensor, optical sensor and/or infrared sensor.

Thus the security system which is proposed here comprises different monitoring elements being connected to a controller allowing to have an alerting and/or activating of countermeasures being dependent thereof.

This has the advantage, inter alia, that potential aggressors or invaders must conquer an intelligent monitoring and alerting system to enter the ship.

It might be that for example an optical camera, infrared camera and or radar apparatus is used as a monitoring device by means of which a piracy attack is indicated. Likewise and for example an acoustic sensor, movement sensor, optical sensor and/or infrared sensor can be used as a monitoring sensor. In this context it is possible that the system or the controller triggers an alarm and/or activates alarm devices if at least one of the different monitoring elements (monitoring devices or sensors) indicates a piracy attack.

For this it is advantageous when a predetermined alert stage is triggered, in particularly when a silent alert or a non-silent alert is triggered as a function of the display or indications from the monitoring device or from the sensors.

It is also advantageously when, as a function of the indications, one or more of the conduit systems are activated or will be activated in order to discharge at least one substance. In this context it is an advantage when, as a function of the indications, one or more outlets are activated or will be activated in order to let discharge the substance at particular sections and/or levels of the ship's hall.

Moreover, the separate conduit systems can also be installed at different positions or sections of the hall and can specially be activated there, whereby the needed energy expenditure and the consumption of materials of used substance can be reduced. It is also possible to provide a targeted use of the different substances via the different separate conduit systems. Further to this it is possible to design the separate conduit systems and the connected outlets in various constructions in order to discharge the substance or the different substances in various manners such as spraying, atomizing, sprinkling or pouring out the substances.

These and further advantageous embodiments also result from the dependent claims.

Accordingly it is advantageous when the marine security system comprises a recording device which records and particularly logs the signals and or indications coming from the monitoring elements in case of an alarm and/or which records and particularly logs the alarm alert stages or activations of alarm devices triggered by the controller. Thus a so-called black box is provided having the characteristic to record and to log especially alarm based signals, displays and/or events (triggering, activating). Further to this it can be foreseen that the recording device records and in particularly logs the status, in particular positions and speed of the ship on which the security system is installed. Thus each arising piracy attack becomes documented in a very high comprehensive manner. In this so-called black box all recordings are stored by the system (sensors and the corresponding evaluation, protocol). Also every movement of the ship can be documented. The recorded data can also be secured outside the ship e.g. by continuous transmission via satellite. The black box can be installed or hided on the ship at any place, because of its small structure. It is also possible to operate a plurality of such recording devices within the security system, wherein the recording devices may operate in parallel and thus provide a redundancy for high security with regard to data mining and storage.

In connection with several separate conduit systems it is especially advantageous when the outlets of the separate conduit systems are arranged at different sections of the hull and are arranged along the railing. Also it is advantageous when the separate conduit systems are arranged on different levels or floors of the hull in particularly are arranged at or below the railing.

Further to this and in an advantageous manner the outlets of the separate conduit systems can be arranged in a sectional interlaced manner in particularly in an alternating order to each other. The outlets can also be preferably arranged in portions and/or panels of the hull which partially overlap to each other.

It is also an advantage when the outlets are designed as spray nozzles and/or as permeable membranes.

Preferably a controllable valve is foreseen that produces a pulsating supply of the substance within the particularly conduit system and/or valves to the connected outlets. Preferably there are separately controllable valves for at least two of the separate conduit systems, the valves producing within the conduit systems and/or in the connected outlets various supplies of different substances. In this context it is of an advantage when at least two tanks are foreseen in the hull, the tanks being connected to the valves or pumps and containing different substances or concentrations thereof.

Further to this it is an advantage when separately controllable valves are foreseen for at least two of the separate conduit systems, the valves producing in the conduit systems and/or the connected outlets different types of supply of the substance or the different substances. In this context it is especially advantageous when the valves are controlled by the controller such that the different types or forms of supply comprise pulsed or clocked flow pulses which differ from each other in their amplitudes, durations and/or timeslots.

Also special advantages can be achieved when at least one of the separate conduit systems comprises a controllable valve which produces a dosed discharging of the substance at the outlets.

It is also of an advantage when the controller controls the pumps and/or the valves such that the supply of the substance is at least temporarily provided only in one of the separate conduit systems. Moreover it is of an advantage when at least one pump is provided which is connected to an intake pipe being installed at the hull below the water surface and to at least one of the conduit systems and/or the tanks to suck water from outside.

Further it is of an advantage when at least one of the outlets is designed as a manually operated on-board spraying cannon.

Preferably the used substance is a mixture of water, lubricating liquid and/or defense liquid. In this connection it is of an advantage when the defense liquid contains at least an irritant for the human mucous membranes.

The marine security system can preferably also comprise a mixer which is connected to the intake pipe and which produces the mixture in particularly by sucking sea water.

In the following the invention and the advantage derived therefrom will be described by means of embodiments and references to the enclosed figures wherein the figures show the following:

Figure 4A:
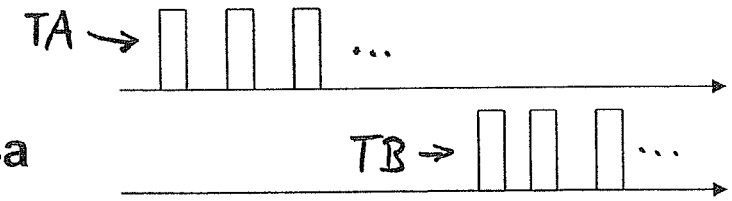

FIGS. 4*a* and *b* show different pulsing to control the conduit systems.

Figure 5:
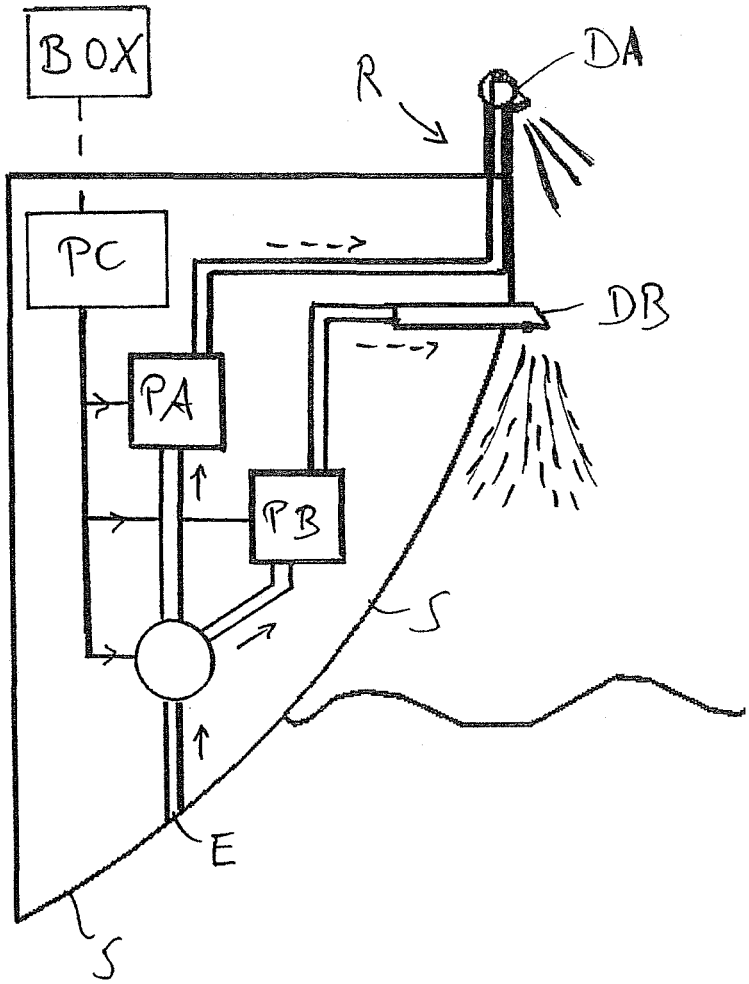

FIG. 5 shows in a further embodiment the arrangement of two conduit systems on different levels of the hull.

Figure 6:
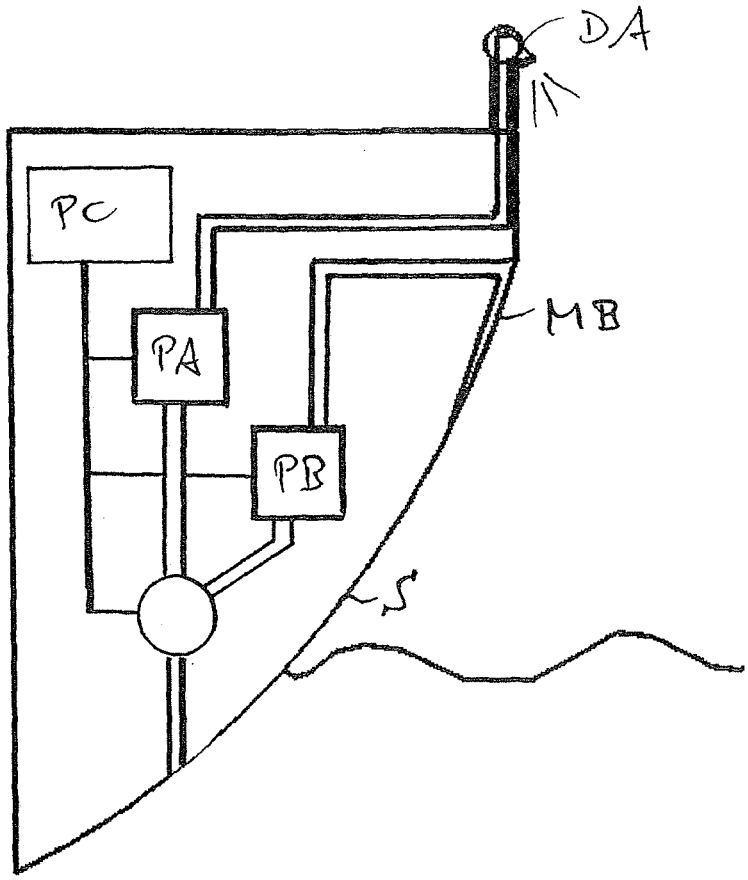

FIG. 6 shows as a variant for FIG. 5 the embodiment of an outlet of the lower conduit system being designed as a permeable membrane.

Figure 7:
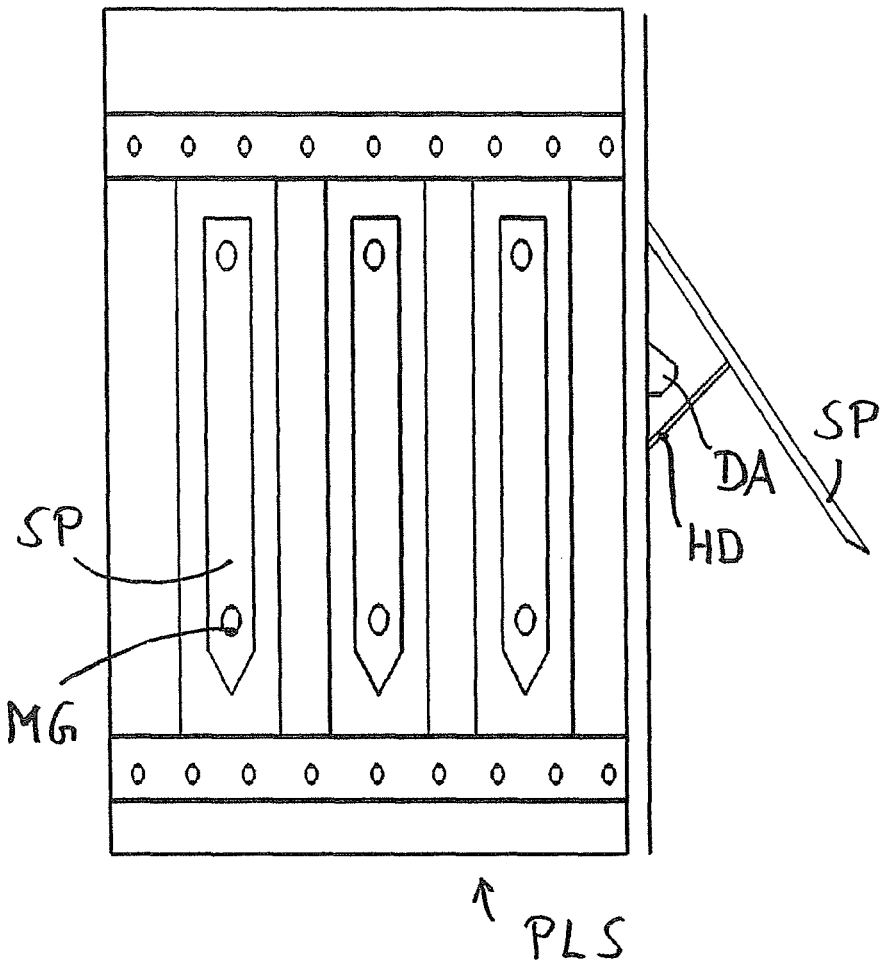

FIG. 7 shows additional preventive measures for the extension of the marine security system.

Figure 8:
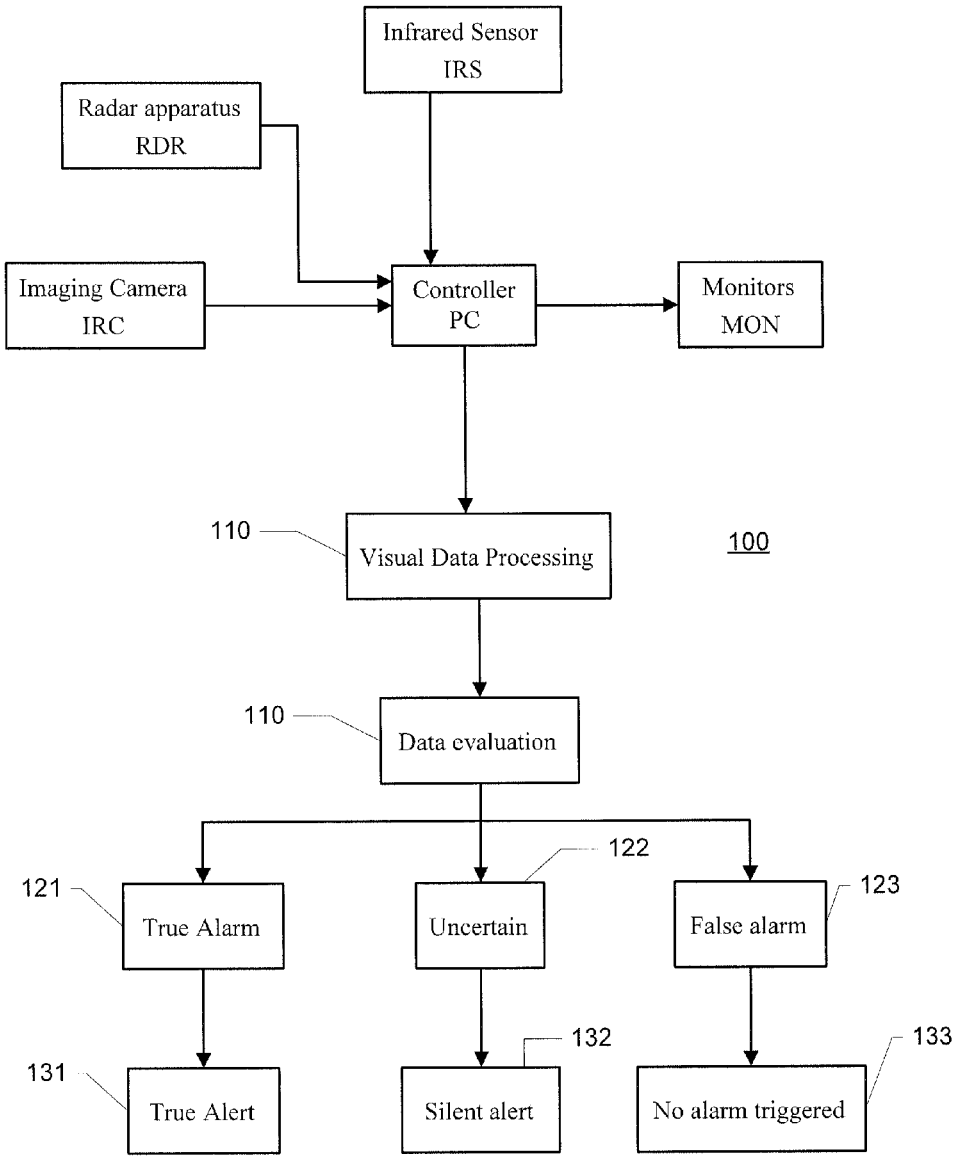
Figure 9:
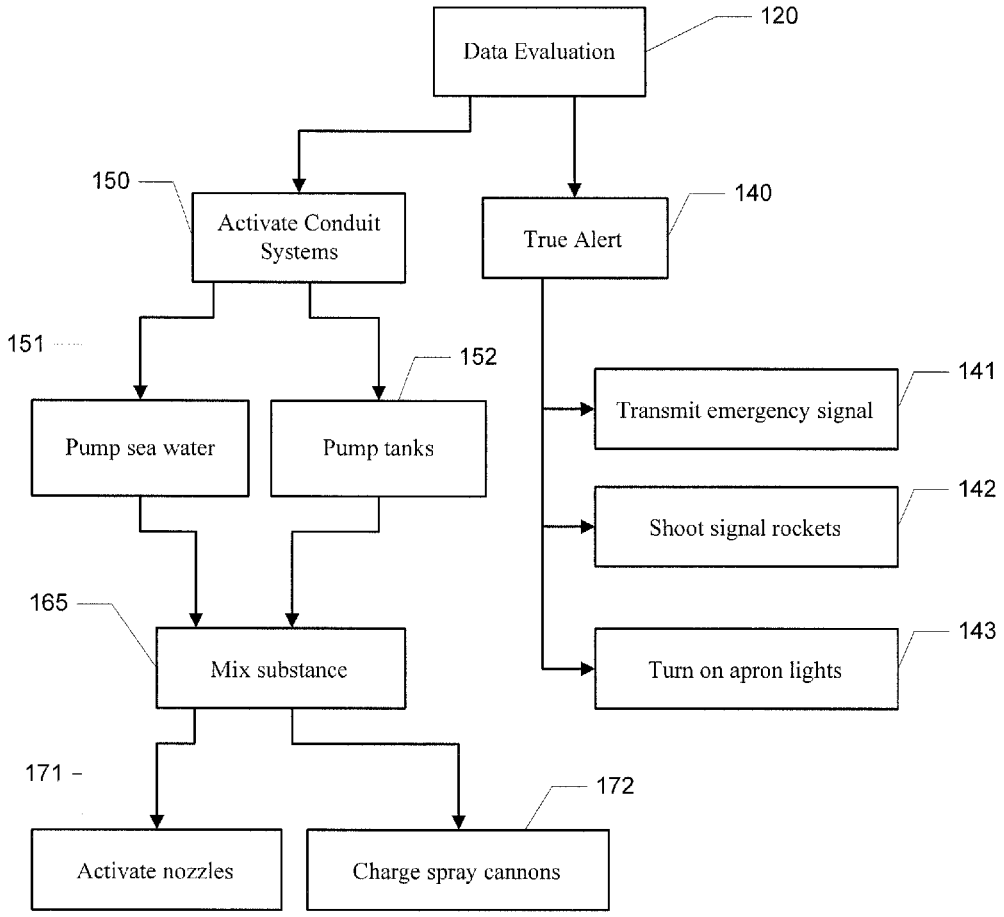

FIG. 8 and FIG. 9 show flow diagrams for monitoring and alerting programs which are performed by the system.

Figure 1:
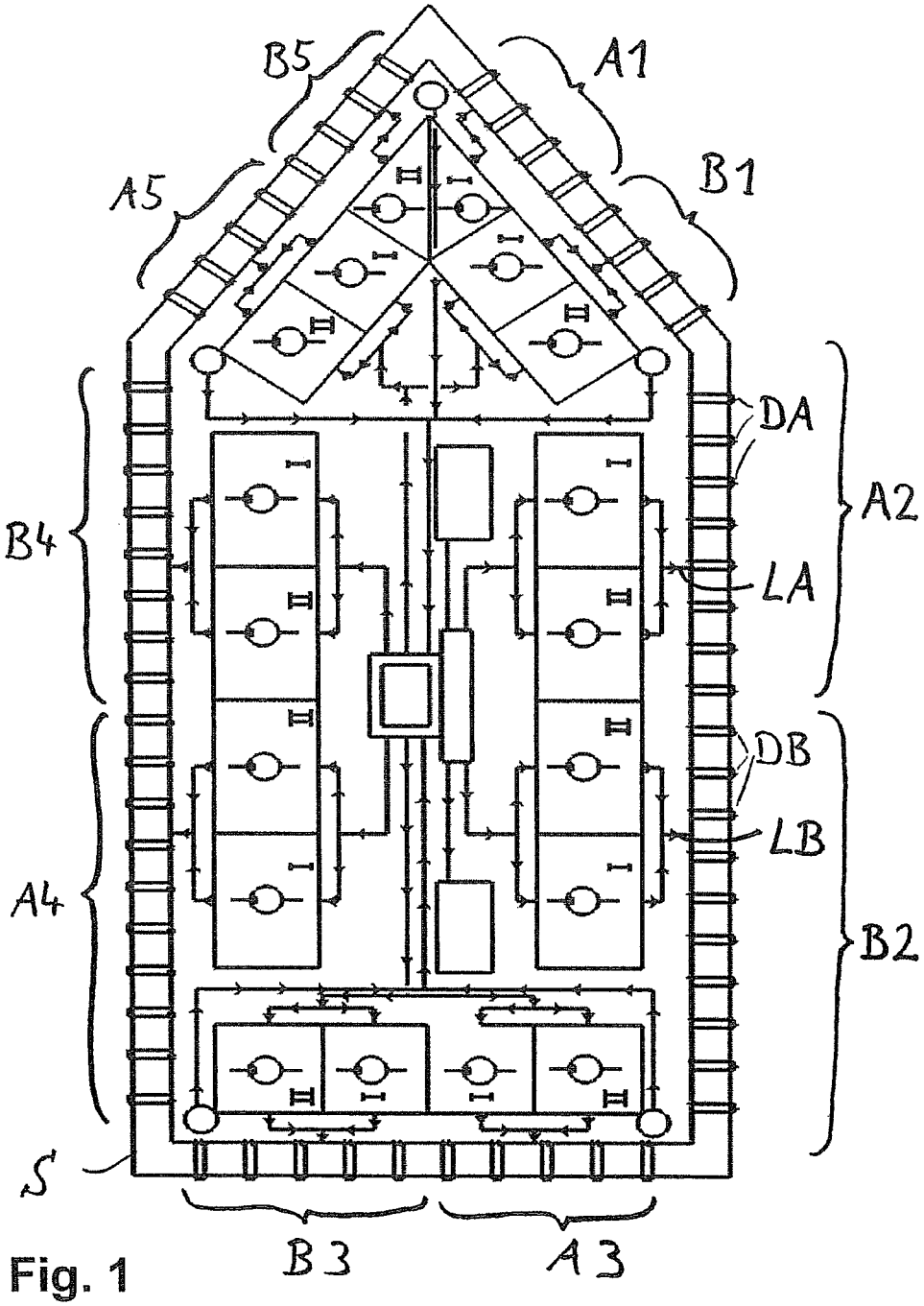
FIG. 1 shows the first embodiment of the invention in which the different sections of a hull are provided with separate conduit systems and outlets connected thereto.

FIG. 1 shows in a schematic drawing the plan view of a hull S with a security system LG being arranged therein, wherein different portions or sections A1, A2, . . . A5, B1, B2, . . . B5 are supplied along the railing of the ship's hull S by separate conduct systems and outlets being connected thereto. For this there are outlets, preferably in form of spray nozzles, arranged along the railing in predetermined distances, the nozzles being connected section by section with one of the conduit systems which in turn are controlled by a central computer or controller. The details are shown in FIGS. 2, 3 and 5 and 6.

In the embodiment shown in FIG. 1 there are in total ten sections A1, A2, . . . A5, B1, B2, . . . B5 being supplied along the railing R and being separately controllable. Thus the section A1 at the rear e.g. cab be separately controlled and can specifically repel an attack which possibly may occur in there. The same applies for the other separate sections. The several sections may also commonly be controlled like the sections A2 and B2 at the starboard side. Or the area at the bow of the ship can fully be protected by controlling the sections A3, B3, A4 and B4. By dividing the marine security system into several different conduit sections and with the outlets DA and DB connected thereto, a very flexible and targeted defense can be achieved. Further to this the different sections A1, A2, . . . A5, B1, B2, . . . B5 can also be supplied with different substances or mixtures of various materials. For example the system is provided basically with two differently filled tanks I and II, the one contains a lubricant, the other one contain a defense liquid. By means of a mixer which is provided in the system the different materials are mixed with water to an effective substance which can then be supplied via the conduit system LA or LB to the outlets DA or DB, respectively. The water can be obtained for example via an intake pipe E from sea water (see FIGS. 5 and 6).

Figure 2:
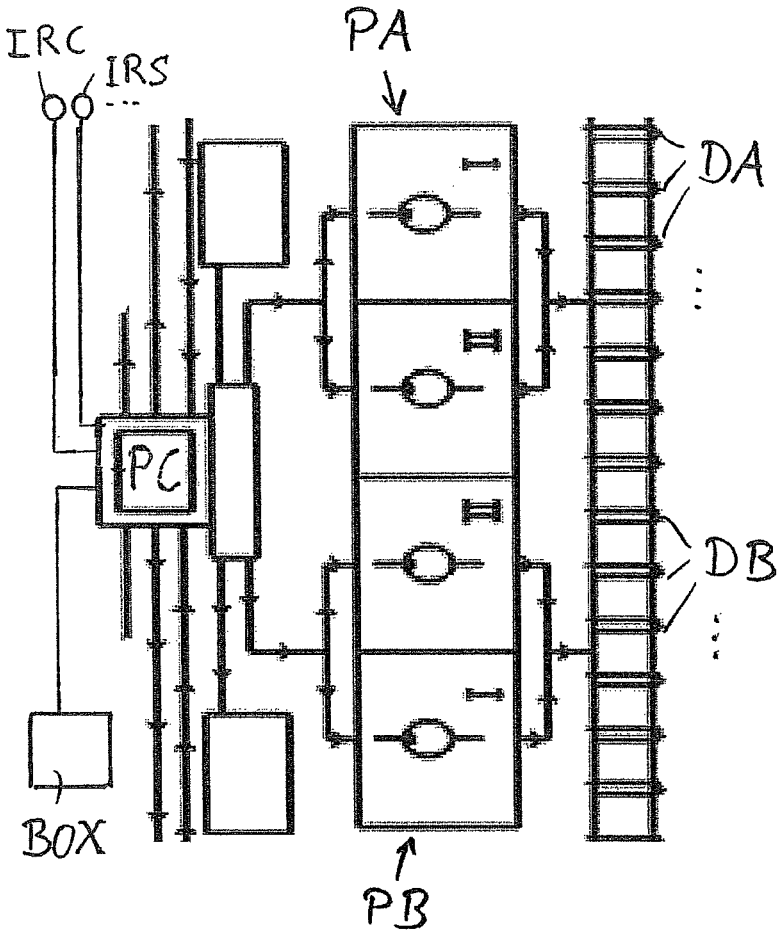
FIG. 2 shows in detail the structure of the marine security system for such a section.

The FIG. 2 shows in detail of the drawing the basic elements of the marine security system according to FIG. 1. Thus the system contains the outlets DA and DB which are designed in form of spray nozzles being connected to one of the different conduit systems LA or LB, respectively. The different conduit systems are centrally controlled by a controller PC, wherein this controller preferably controls the pumps PA or PB and the valves provided in that conduit systems.

Moreover the system comprises a recording device BOX which, at least in the case of an alarm, records the signals and/or indications coming from the monitoring elements and/or monitors and particularly logs the alarms or alert stages or activations of alarm devices triggered by the controller.

This is a kind of a so-called black box having the specialty to record in particular alarm-based signals, indications and or events (triggering, activating) and to log them (also see FIG. 5). In addition it can be foreseen, that the recording device BOX, at least in case of an alarm, also records and especially logs the status or condition in particular the position and speed of the ship on which the security system is installed. Thus each occurring piracy attack is documented in a very comprehensible manner. In this so-called black box all recordings of the system (sensors and the corresponding evaluation, protocol) is stored. Further to this all movements of the ship can be documented. The recorded data may be secured outside of the ship, e.g. by frequent transmissions via satellite. Due to its small structure or design, the black box can be installed and hidden at each place of the ship. It is also possible to operate with a plurality of such recording apparatuses within the security system, the apparatuses may operate in parallel and thus provide a redundancy for higher security with respect to data mining and storing.

Figure 3:
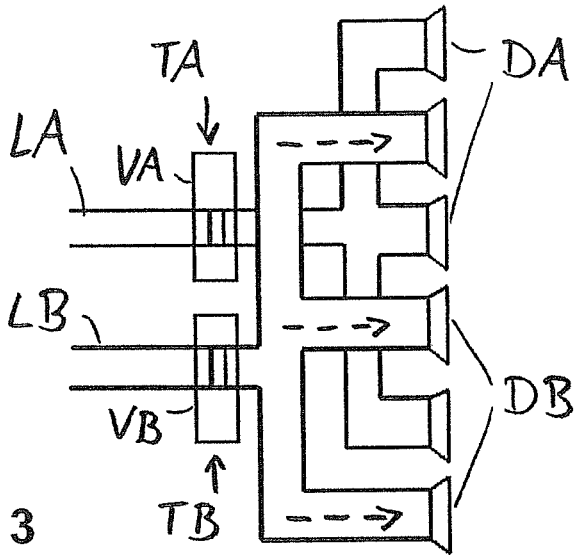
FIG. 3 shows in a further embodiment the arrangement of outlets for a pulsed discharging of the substance.

As it is shown in FIG. 3 the outlets or spray nozzles DA and DB can be arranged in an interleaved or interlaced manner. Thus an alternating spraying or sprinkling of aggressors via respective nozzles DA or DB is possible. Further to this the system comprises a controller PC which provides a pulsed supply of the respective substance into the conduit systems LA or LB. By means of this pulsed supply and the succeeding dischargement out of the outlets or spray nozzles DA and DB a very effective and also material economized defense can be achieved. Pulsed dischargement can for example be achieved by clocking the respective valves.

Figure 4B:
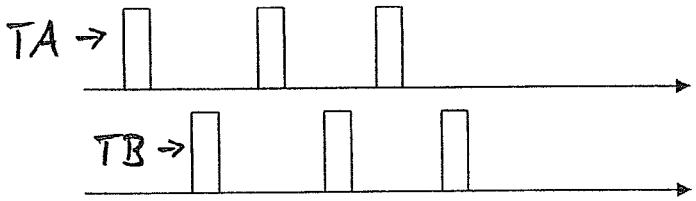

In FIGS. 4*a* and 4*b* various clocked pulsings TA and TB are illustrated. According to FIG. 4*a* the spray nozzles DA are first controlled temporarily in an alternating mode for several times and are then this is supplied to the spray nozzles DB. By means of the pulsing of FIG. 4*b* an alternating control of the nozzles DA and DB is provided. Many other clocked pulsings are possible and can be optimized for the respective use case.

In FIG. 5 a partial cross sectional view of the hull S is shown for illustrating in more detail the arrangement of the marine security system having different conduit systems LA and LB. The central controller PC particularly controls the pumps PA and PB foreseen for the conduit systems, the pumps in turn being connected to a central pump which sucks sea water through an intake pipe E. In addition the pumps PA and PB are connected to the afore-mentioned tanks I and II in order to produce said mixture which is then supplied via the conduit systems LA and LB to the respective outputs or spray nozzles DA and DB. In the embodiment shown here the conduit systems and outlets DA and DB are foreseen for different levels or planes of the hull S in order to achieve a spatial cascaded multiple defense measure.

The nozzles DA of the first conduit system LA are for example installed along the railing R and are designed as spray nozzles. The nozzles DB of the second conduit system LB are arranged below the railing R and extend from the hull S, wherein these nozzles preferably discharge the substance in form of atomized spray which then deposits at the outer wall of the hull S. Because of that the substance contains, inter alia, grease or lubricant, the outer wall of the hull S becomes oily and slippery for the aggressors and can therefore only hardly be boarded. As a second and additional defense measure the substance will then be sprayed towards the aggressors in a targeted manner along the railing R. Both measures together make a boarding of the ship significantly more difficult.

The FIG. 6 shows an alternative embodiment to those of FIG. 5, wherein the outlets of the second conduit system LB are now designed as a permeable membrane MB which is integrated in the hull S. Thus the substance is discharged along the wall of the hull, wherein the hull virtually sweats and also becomes slippery and oily for the aggressors. Further embodiments of the outlets and nozzles and membranes are possible.

In FIG. 7 as an additional measure there is shown a defense flap or a palisade-like hatch in form of a palisade pre-fabricated element PLS, each palisade extending with its spure or nose SP from the ship's side in case of an attack and thus preventing invaders from climbing up the hull. If there is an alert the respective nose SP will jerkily be driven out hydraulically by means of a hydraulic HD or will jerkily be driven out pneumatically. Thereupon a nozzle DA behind it will be activated and the defense mixture, as already been described, will be discharged. In the passive state the palisade shield or plate or the palisade as such is hold by means of magnets MG which can for example be electro-magnets, and is thus secured in the retracted state. In case of an alert the palisade or noses SP are then released in order to jerkily drive out from the ship's wall so that the spray nozzles DA behind them may then spray the substance in a targeted manner towards the aggressors.

The nozzles can be controlled by various clockings (also see FIG. 4*a/b*). For example the nozzles 1, 3, 5 are controlled in a first cycle and the nozzles 2, 4, 6 are controlled in a second cycle. The substance or liquid is compressed by the pumps such that a relative high pressure can be achieved. Thus the substance or liquid is not simply discharged but rather sprayed in an abrupt or jerky manner.

The marine security system being described here can also be equipped with an intelligent monitoring and alerting system which operates according to a program which will be described in more detail further down below by means of FIGS. 8 and 9. The system is provided with monitoring devices or sensors which are connected to the controller PC. Devices of sensors can be for example cameras, radar apparatuses, moving sensors or the like. If an alarm or attack is indicated by said monitoring elements the controller PC will trigger an alert and/or will activate alarm systems such as apron lighting or signal rockets etc. The triggered alert can be produced in predetermined stages or forms such as still alert or non-still alert, wherein this is produced dependently from the status indicated by the monitoring elements. The triggering of an alarm or the activating of an alarm device can for example occur in the following steps:

First an apron lighting is activated and signal rockets are fired. Then an emergency signal is transmitted. Then the valves at the tanks I and II or at fresh water pumps are opened. The mixing ratio of defense fluid, lubricant and sea water can exactly be adjusted by controlling the valves or pumps. The valves sputter the mixture containing the water, the lubricant fluid and the defense fluid to a fine mist within a large radius up to 360° from the ships wall. The mixture overlies the ships wall and the boarding equipment of the aggressors and irritates the mucosal. The crew on the ship then takes the water cannons and hoses being connected to the marine security system and being operated with the same defense mixture. By means of the security system the aggressors are severely hindered and are at most stopped. This leads to a significant time advantage which allows the crew to react on the attack.

Further to this a signal lamp can also be installed at each ship-board section (see A1 to A5, B1 to B5 in FIG. 1) being easily visible for the crew. Thus the crew of the ship will be in the position to quickly visually locate the attacked area on deck of the ship.

As shown in FIG. 8, the method 100 of the program being performed by the controller PC may run as follows:

The monitoring devices or sensors such as e.g. a thermal imaging camera IRC, a radar apparatus RDR or an infrared sensor IRS, indicate an alarm situation to the controller PC. The controller forwards the pictures of the thermal imaging camera IRC as well as that of the radar apparatus RDR to special monitors MON on the bridge of the ship. Then in a first step 110 a visual data processing and/or in a step 120 a data evaluation of the received data is performed by the controller PC. The evaluation leads within at least one succeeding step 121 to 123 to an classification of the situation in a predetermined alert stage. For example, in dependence of the received data a true alarm is detected in substep 121, i.e. as a true threatening situation is detected, or in substep 123 a false alarm is detected. If the data situation is not unambiguous the system will then detect in substep 122 the status "uncertain" and will trigger in a succeeding step 132 a silent alert in order not to alarm the whole crew but only the sergeants of the guard on the bridge who then can clarify the situation by themselves. On the other hand the first substep 121 directly leads to a succeeding step 131 in which a true alert is triggered. The substep 123 in turn leads to a succeeding step 133 in which no alarm is triggered.

The controller PC also triggers in frequent time intervals and in step 120 a maintenance program of the system in which particularly the conduit systems LA and LB as well as the outlets are flushed and cleaned with fresh water.

In FIG. 9 and starting from step 120 or 130 it is described how the system triggers various alerts within the sequence of steps 140 and activates single components of the system:

If for example a true alert is detected, the system or the controller PC will trigger in step 141 the transmission of an emergency signal (SOS). Likewise the shooting of signal rockets can also be triggered in step 142. In a step 143 the apron lighting on the ship can also be switched on.

In the sequence of steps 150 the various components are controlled, in particularly the pumps and/or the valves of the systems, for activating the conduit systems for the targeted spraying of the at least one substance towards potential aggressors:

In a step 151 sea water is sucked. And in step 152 the tanks containing the ingredients for the at least one substance are sucked. By activating the respective pumps within step 160 the preparation of the substances by mixing the different ingredients within step 165 is performed. Afterwards the respective substance is supplied to the desired sections or outlets. In step 171 the nozzles are activated at that section or area of the hull which has been recognized as place of an attack. In step 172 the spraying cannons being installed on board are charged with the substance.

In summary a marine security system is proposed which hampers or completely stops the capture of ships by pirates, terrorists or other unwanted persons. The outer skin or wall of the ship beneath the railing is continuously monitored by electronic sensors such as moving sensors, contact wires etc. or by visual sensors such as thermal cameras. Once an aggressor or invader approaches and tries to get entrance to the deck of the ship by means of ladders, grappling hooks or the like, this will be detected by the sensors and an alert will be triggered. Also the discharge of the substance will be activated. Once an acute alarm is triggered by the security system the valves are opened and the mixture being stored in the tanks or mixed there will be fed via the conduit systems to the outlets. When the pirates or aggressors get into contact with the sprayed substance they will be stopped in their intention because of the slippery characteristic of the substance as well of the mucous irritating properties in several respect. It turned out that a soap solution is to be preferred as lubricant because it is a natural product which does not produce pollution. In a very simple case the system can be designed like a fire protection system or a sprinkler system, but can also be very complex, depending on the case of use, and can be optimized for the respective use. The proposed system makes it possible to provide in particular sea-going vessels with a better protection such that no trained task forces are needed for protecting the ship. Also because of the automatic monitoring and activation of system components the use of trained personnel is not required. The substance is preferably pulse-like sprayed and represents a mixture of water, lubricant and/or defense liquid.

LISTS OF REFERENCE SIGNS

S hull of the ship or vessel
LG marine security system
PA, PB pumps connected with tanks I, II
I, II tank or containers
LA, LB lines or conduit system
DA, DB nozzles or outlets
MB outlet designed as permeable membrane
A1-A4; B1-B4 portions of the ship hull
R railing
PC controller
TA, TB pulsings VA, VB valves
IRC control device in the form of a thermal image camera
RDR control device in the form of a radar apparatus
IRS control sensor in the form of an infrared sensor
MON monitor or screen on the ship's bridge
BOX recording device (so-called black box)
100 method of controlling and alerting
110 to 172 single method steps
PLS palisade, prefabricated element
SP ram or nose, hydraulic extensible
HD hydraulics
MG magnets or electro-magnets

The invention claimed is:

1. A marine security system for a ship comprising:

outlets for a liquid or gaseous substance, the outlets being mounted at a hull of the ship, the substance being supplied to the outlets by means of at least one pump via conduits in order to discharge the substance at the outside of the hull to fend off an attack of pirates, at least two different monitoring elements comprising optical and non-optical monitoring elements, a controller which activates alarm devices as a function of indications from the different monitoring elements, and at least two separate conduit systems and outlets being connected thereto, wherein the at least two separate conduit systems comprise separately controllable valves, the valves producing different modes of supply of the substance, the different modes include clocked flow pulses which differ from each other in their amplitudes, durations, or time slots.

2. The marine security system according to claim 1, wherein the different monitoring elements are designed as monitoring devices or monitoring sensors, the monitoring elements selected from a group consisting of an optical camera, an infrared camera, a radar apparatus, an acoustic sensor, movement sensor, an optical sensor and an infrared sensor.

3. The marine security system according to claim 1, wherein the controller triggers a predefined alert phase, in particular a silent or non-silent alarm, as a function of the indications from the at least two monitoring elements.

4. The marine security system according to claim 1, further comprising a recording device which records and logs the indications from the different monitoring elements in case of an alarm and records and logs the activations of alarm devices triggered by the controller.

5. The marine security system according to claim 4, wherein in the case of an alarm the recording device records and logs the status of the ship on which the security system is installed.

6. The marine security system according to claim 1, wherein the controller activates one or more of the at least two separate conduit systems in order to discharge the substance via the outlets, and the controller activates one or more outlets of the at least two separate conduit systems in order to discharge the substance via the outlets at specific portions of the ship's hull.

7. The marine security system according to claim 1, wherein the outlets of the at least two separate conduit systems are arranged at different portions of the hull and that the outlets of the at least two separate conduit systems are arranged in portions in an interleaved manner and the outlets of the at least two separate conduit systems are arranged in portions which partially overlap.

8. The marine security system according claim 1, wherein the outlets are designed as spray nozzles, permeable membrane or a controllable valve for at least one of the conduit systems, wherein the controllable valve produces a pulsed supply of the substance to the respective conduit system and the outlets connected thereto.

9. The marine security system according to claim 1, wherein the at least two separate conduit systems comprise separately controllable valves, the valves producing the substance, wherein at least two tanks are provided in the hull, the tanks being connected with valves or pumps and containing the substance.

10. The marine security system according claim 1, wherein at least one of the separate conduit systems comprises a separately controllable valve, the valve producing a dosed discharge of the substance.

11. The marine security system according to claim 1, wherein the controller controls at least one pump and valves such that the substance is temporary provided only in one of the separate conduit systems and at least a pump connected to an intake pipe on the hull below the water surface and to at least one of the conduit systems or one or more tanks to suck water from outside the ship.

12. The marine security system according claim 1, wherein the substance is a mixture of water, lubricating liquid or defense liquid, where the defense liquid contains at least one irritant for a human mucosas.

13. The marine security system according to claim 12, further comprising at least a mixer connected to the intake pipe, and wherein the mixer produces a mixture.

14. The marine security system according claim 1, wherein the outlets are spray nozzles, permeable membrane, or a controllable valve provided for at least one of the conduit systems, where the valve produces a pulsed supply of the substance to the conduit system and the outlets connected thereto.

15. The marine security system according to claim 8, wherein the conduit comprises separately controllable valves, the valves producing the substance, wherein at least two tanks are provided in the hull, the tanks being connected with valves and/or pumps and containing the substance.

16. The marine security system according to claim 1, wherein the controller controls the pumps and valves such that the substance is at least temporary provided in one of the separate conduit systems to the connected outlets and that the pump is connected to an intake pipe on the hull below the water surface and to at least one of the conduit systems and one or more tanks to suck water from outside the ship.

17. The marine security system according claim 1, wherein the substance is a mixture of water, lubricating liquid or defense liquid, where the defense liquid contains at least one irritant for a human mucosas.

18. The marine security system of claim 1, wherein the outlets of the at least two separate conduit systems are arranged at different portions of the hull, and wherein at least two tanks are provided in the hull, the tanks being connected with the valves and pumps and contain the substance.

19. A marine security system comprising:

outlets for a liquid or gaseous substance, the outlets being mounted at a hull, the substance being supplied to the outlets by means of at least one pump via lines or conduits in order to let the substance discharge at the outside of the hull to fend off an attack of pirates, at least two separate conduit systems and outlets being connected thereto, wherein the marine security system comprises at least two different monitoring elements and a controller connected thereto which activates alarm devices as a function of indications from different monitoring elements;

wherein the controller triggers a predefined alert phase, comprising a silent alarm, as a function of the indications from the at least two monitoring elements, and wherein the at least two separate conduit systems comprise separately controllable valves, the valves producing different modes of supply of the substance, the different modes include clocked flow pulses which differ from each other in their amplitudes, durations, or time slots.

20. A marine security system comprising:

outlets for a liquid or gaseous substance, the outlets being mounted at a hull, the substance being supplied to the outlets by means of at least one pump via conduits in order to let the substance discharge at the outside of the hull to fend off an attack of pirates, at least two different monitoring elements and a controller connected thereto which activates alarm devices as a function of indications from different monitoring elements;

a recording device which records and logs signals coming from the different monitoring elements, and at least two separate conduit systems and outlets being connected thereto, wherein the at least two separate conduit systems comprise separately controllable valves, the valves producing different modes of supply of the substance, the different modes include clocked flow pulses which differ from each other in their amplitudes, durations, or time slots.

21. A marine security system comprising:

outlets for a liquid or gaseous substance, the outlets being mounted at a hull, the substance being supplied to the outlets by means of at least one pump via conduits in order to let the substance discharge at the outside of the hull to fend off an attack of pirates, at least two different monitoring elements and a controller connected thereto which activates alarm devices as a function of indications from the different monitoring elements; and at least two separate conduit systems and outlets being connected thereto, respectively;

wherein the controller activates one or more outlets of the separate conduit systems in order to let discharge the substance via these outlets at certain portions of the ship's hull, and wherein the at least two separate conduit systems comprise separately controllable valves, the valves producing different modes of supply of the substance, the different modes include clocked flow pulses which differ from each other in their amplitudes, durations, or time slots.

22. A marine security system comprising:

outlets for a liquid or gaseous substance, the outlets being mounted at a hull, the substance being supplied to the outlets by means of at least one pump via conduits in order to let the substance discharge at the outside of the hull to fend off an attack of pirates, at least two different monitoring elements and a controller connected thereto which activates alarm devices as a function of indications from the different monitoring elements; and at least two separate conduit systems and outlets being connected thereto, respectively;

wherein the outlets of the separate conduit systems are arranged on different planes or floors of the hall at or below the railing, and wherein the at least two separate conduit systems comprise separately controllable valves, the valves producing different modes of supply of the substance, the different modes include clocked flow pulses which differ from each other in their amplitudes, durations, or time slots.

23. A marine security system comprising:

outlets for a liquid or gaseous substance, the outlets being mounted at a hull, the substance being supplied to the outlets by means of at least one pump via conduits in order to let the substance discharge at the outside of the hull to fend off an attack of pirates, at least two different monitoring elements and a controller connected thereto which activates alarm devices as a function of indications from the different monitoring elements;

at least two separate conduit systems and outlets being connected thereto, respectively; and at least two of the separate conduit systems comprise separately controllable valves, the valves producing at the outlets the substance, wherein at least two tanks are provided in the hull, the tanks being connected with the valves and pumps and containing the substance or concentrations thereof wherein the valves producing different modes of supply of the substance, the different modes include clocked flow pulses which differ from each other in their amplitudes, durations, or time slots.

24. A marine security system comprising:

outlets for a liquid or gaseous substance, the outlets being mounted at a hull, the substance being supplied to the outlets by means of at least one pump via conduits in order to let the substance discharge at the outside of the hull to fend off an attack of pirates, at least two different monitoring elements and a controller connected thereto which activates alarm devices as a function of indications from the different monitoring elements;

at least two separate conduit systems and outlets being connected thereto, respectively;

wherein at least two of the separate conduit systems comprise separately controllable valves, the valves producing in the conduit systems and at the connected outlets different modes the substance, wherein the different modes include clocked flow pulses which differ from each other in their amplitudes, durations, or time slots.

* * * * *